US005103204A

United States Patent [19]

Hartman

[11] Patent Number: 5,103,204

[45] Date of Patent: Apr. 7, 1992

[54] LYTE-COM

[76] Inventor: Randall L. Hartman, P.O. Box 3585, Gastonia, N.C. 28054

[21] Appl. No.: 393,412

[22] Filed: Aug. 14, 1989

[51] Int. Cl.[5] ..... G08B 5/00

[52] U.S. Cl. ..... 340/332; 340/286.01; 340/286.07; 340/326

[58] Field of Search ..... 340/332, 825.19, 286.01, 340/286.02, 286.07, 286.08, 286.09, 286.11, 326, 329, 331, 321, 815.01, 851.1, 286.06

[56] References Cited

U.S. PATENT DOCUMENTS

| | | | |
|---|---|---|---|
| 2,312,649 | 3/1943 | Kelly | 340/321 |
| 2,799,854 | 7/1957 | Barnes | 340/321 |
| 3,261,011 | 7/1966 | Crosthwait | 340/286.07 |
| 3,353,173 | 11/1967 | Beilfuss | 340/286.08 |
| 3,668,682 | 6/1972 | Barbee et al. | 340/286.07 |
| 3,821,707 | 6/1974 | Peters | 340/286.09 |
| 4,237,344 | 12/1980 | Moore | 340/286.07 |
| 4,275,383 | 6/1981 | White et al. | 340/286.07 |
| 4,365,238 | 12/1982 | Kollin | 340/332 |
| 4,418,334 | 11/1983 | Burnett | 340/286.07 |
| 4,468,814 | 8/1984 | Field | 340/332 |
| 4,768,014 | 8/1988 | Pettit | 340/332 |
| 4,847,589 | 7/1989 | Dobbins | 340/321 |

OTHER PUBLICATIONS

Linear Databook, National Semiconductor Corporation 2900 Semiconductor Drive Santa Clara, Calif., pp. 1, 2 and 9-33 to 9-38.

*Primary Examiner*—Jin F. Ng
*Assistant Examiner*—Brent A. Swarthout
*Attorney, Agent, or Firm*—Bell, Seltzer, Park & Gibson

[57] ABSTRACT

A portable visual signalling device consists of a plurality of different colored lights and a plurality of switches in a housing. Each light may correspond to a specific designation. The device is powered by a self contained rechargeable battery and recharging circuitry. A switch can be flipped to activate a colored light and provide a visible message. It does not have to be professionally installed. The device can be moved easily from place to place if needed. One or more lights can be activated by remote control. A buzzer may also be activated with one of the lights.

2 Claims, 1 Drawing Sheet

LYTE-COM

FIELD OF THE INVENTION

This invention relates to communications systems.

BACKGROUND OF THE INVENTION

In the daily operation of my office, I found it very difficult to locate my staff members and thereby coordinate our duties. A lot of time and energy was being wasted. It became apparent that a non-verbal form of communication system was necessary at strategically located message centers. Non-verbal communication systems are available using lights or flags. The systems with lights were very costly and needed professional installation which was also costly.

SUMMARY OF THE INVENTION

Having a limited background in electronics, I developed a system using lights which is less costly and is simply installed. It requires no professionals. The various colored lights have specific assignments. This allows messages to be left on a unit which can be seen a long distance and therefore allow a much smoother and more efficient performance of our duties.

After over four years of testing and developing, I have come up with 2 models which I feel are ready to market. One unit has a manual emergency circuit and the other has a manual remote emergency circuit.

The LYTE-COM voiceless communication device is a battery powered device, used for communication.

The device is made of a thermoplastic housing with different colored lamps, indicating different commands. The device uses transistors, and a remote control, to switch lights OFF and ON. The device has the ability to store power from an A.C. source and use it from a D.C. battery. It does not require costly wiring. LYTE-COM is a voiceless communication device used to communicate without speaking.

DESCRIPTION OF THE PREFERRED EMBODIMENT

Figure 1:
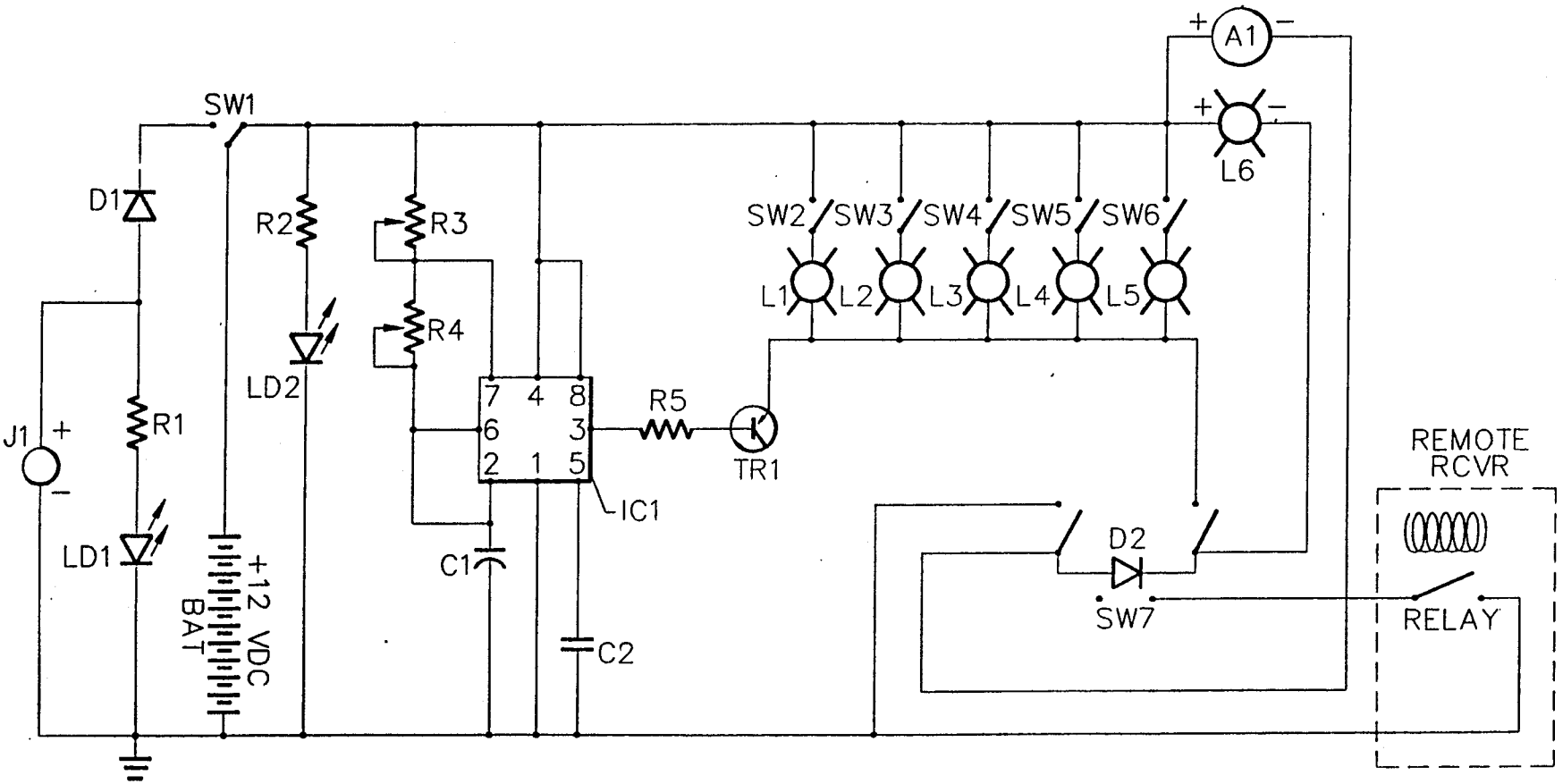
FIG. 1 is a schematic diagram of an embodiment of the present invention.

The present invention now will be described more fully hereinafter with reference to the accompanying drawing, in which a preferred embodiment of the invention is shown.

FIG. 1 is a schematic diagram of a simple to use device which has a series of colored lights and switches that can be used for communication of a wide variety of messages. It can be used for office, home or industrial settings. Such a system would allow smooth operation and increased production of a multi stage business or process without the usual necessity of time consuming verbal communication.

Personnel involved can flip one or more switches activating the blinking lamps which have previously been associated specific designations. Switches and lamps are located on the face of each unit and can be operated from a right or left handed location. Units are usually wall mounted adjacent to a doorway. Units function equally as well from a desk or table top. Lamps are multi directional and can easily be seen from a long distance.

To facilitate quicker response to a message, the units have a buzzer which can be activated manually or by the use of a remote control activator. The buzzer is also coupled with a special lamp color. The lamp and buzzer will stay on constantly if activated manually. When activated by remote, the lamp and buzzer will act in an intermittent fashion for a limited period of time. The latter mode is often used for emergencies.

Accordingly, the invention provides a voiceless communication system using a variety of colored lights as the primary communicator coupled with sound, in some instances, as a secondary communicator. Various models can have from one to seven functions.

The housing can be made of tough KGB Cycolac molded thermoplastic, and can be 7½" Tall—4½" Wide—2¼" Deep. The cover is ⅛" thick.

The present invention has a number of advantages. The unit is completely portable. No external wiring is required. Power to the unit may be supplied, for example, from a 12 volt self contained battery pack. Accordingly, no costly professional wiring is required. The overnight battery charge lasts all week. Left or Right hand operation of the switches is possible. No screws, nuts and bolts or nails are required for installation. Easy hook and loop fasteners may be used. A Remote wireless emergency circuit is also available. The Units/System do not have to be left behind should a business relocate.

FIG. 1 illustrates a circuit embodiment of the present invention. As may be seen from FIG. 1, a battery BAT such as a 12 volt Ni-Cad battery pack supplies operating power for the unit and is connected to the light control unit through Selector switch SW1, which may be single pole double throw mini switch. The battery BAT may also be connected to a recharging jack J1 and reverse polarity protection diode D1, for example an IN4005 diode, through Selector Switch SW1. Resistor R1 (for example 1 KΩ, ¼ W) and red LED LD1 are connected to jack J1. A green LED LD2 is connected to resistor R2 (for example 1 KΩ, ¼ W) which in turn is connected to switch SW1.

As may also be seen from FIG. 1, pulses generated by a well known 555 timer chip IC1, capacitors C1 and C2 (for example 10 mfd, 35 VDC and 0.016 mFd, 200 VDC, respectively) and variable resistors R3 and R4 (for example, 50 KΩ potentiometers), are coupled to transistor switch TR1 (for example, a PNP general purpose transistor) through resistor R5 (for example a 1 KΩ, ¼ W resistor). Switches SW2–SW6 (for example single pole single throw mini switches) are connected to various colored lamps L1–L5 and to the transistor switch TR1. For example, L1 may be a white indicator lamp, L2 may be a green indicator lamp L3 may be a red indicator lamp, L4 may be yellow indicator lamp and L5 may be a blue indicator lamp. Accordingly, when any of switches SW2–SW6 are turned on, the corresponding colored lamp L1–L5 are turned on and off by switch TR1, so that the corresponding lamp operates. Switch SW7 connects colored lamp L6, for example an orange indictor lamp, to transistor TR1, and also turns on audible signal device A1, for example a 12 volt alarm device.

Still referring to FIG. 1, a remote receiver REMOTE RCVR allows for remote control of lamp L6 and audible signal A1. Lamps L1–L5 are controlled by switches SW2–SW6 and transistor switch TR1 regardless of the setting of switch SW7.

That which is claimed:

1. A portable visual signalling device comprising:

a housing having a face;

a battery power supply disposed within said housing;

a plurality of colored lights mounted on the face of said housing, each of said lights for visually conveying a respective message to an observer;

a plurality of manual switches mounted on the face of said housing, each of said manual switches operatively connected between said battery supply and a respective colored light to operate a respective one of the colored lights via the battery supply;

an audible signal device and a first manual switch associated therewith each mounted on said housing, said first manual switch for operating said audible signal device via the battery power supply for indicating a quick response desired to a message;

a first colored light mounted on the face of said housing and operatively connected to said first manual switch, said first manual switch for also operating said first colored light via the battery power supply for further indicating a quick response to a desired message; and a remote control unit for remotely operating said first colored light via the battery power supply for indicating a quick response desired to a message.

2. A portable visual signalling device comprising:

a housing having a face;

a battery power supply disposed within said housing;

a plurality of colored lights mounted on the face of said housing, each of said lights for visually conveying a respective message to an observer;

a plurality of manual switches mounted on the face of said housing, each of said manual switches operatively connected between said battery supply and a respective colored light to operate a respective one of the colored lights via the battery supply;

an audible signal device and a first manual switch associated therewith each being mounted on said housing, said first manual switch for operating said audible signal device via the battery power supply for indicating a quick response desired to a message;

a first colored light mounted on the face of said housing and operatively connected to said first manual switch, said first manual switch for also operating said first colored light via the battery power supply for further indicating a quick response to a desired message; and a remote control unit for remotely operating said audible signal device and said first colored light via the battery power supply for indicating a quick response desired to a message.

* * * * *

UNITED STATES PATENT AND TRADEMARK OFFICE

CERTIFICATE OF CORRECTION

PATENT NO. : 5,103,204

DATED : April 7, 1992

INVENTOR(S) : Hartman

It is certified that error appears in the above-identified patent and that said Letters Patent is hereby corrected as shown below:

On the title page, item (54) should read:

-- LYTE-COM PORTABLE VISUAL SIGNALLING DEVICE --

Signed and Sealed this

Twenty-eighth Day of September, 1993

Bruce Lehman

*Attest:*

BRUCE LEHMAN

*Attesting Officer*

*Commissioner of Patents and Trademarks*